US007913441B1

(12) United States Patent
Reed

(10) Patent No.: US 7,913,441 B1
(45) Date of Patent: Mar. 29, 2011

(54) SCOPE MOUNT

(75) Inventor: Matthew W. Reed, New Boston, NH (US)

(73) Assignee: L-3 Insight Technology Incorporated, Londonderry, NH (US)

( * ) Notice: Subject to any disclaimer, the term of this patent is extended or adjusted under 35 U.S.C. 154(b) by 238 days.

(21) Appl. No.: 12/366,301

(22) Filed: Feb. 5, 2009

Related U.S. Application Data

(60) Provisional application No. 61/027,047, filed on Feb. 8, 2008.

(51) Int. Cl.
*F41G 1/38* (2006.01)

(52) U.S. Cl. ..... 42/124; 42/125; 42/127

(58) Field of Classification Search ..... 42/124–128
See application file for complete search history.

(56) References Cited

U.S. PATENT DOCUMENTS

| | | | | | |
|---|---|---|---|---|---|
| 2,810,963 | A * | 10/1957 | Harper | 42/127 |
| 3,750,318 | A * | 8/1973 | Burris | 42/127 |
| 4,310,980 | A | 1/1982 | Pilkington | |
| 4,383,371 | A | 5/1983 | Coffey | |
| 4,446,644 | A | 5/1984 | Jimenez et al. | |
| 4,845,871 | A | 7/1989 | Swan | |
| 5,425,191 | A * | 6/1995 | Taylor et al. | 42/124 |
| 5,555,662 | A | 9/1996 | Teetzel | |
| 6,385,893 | B1 * | 5/2002 | Cheng | 42/124 |
| 6,574,901 | B1 | 6/2003 | Solinsky et al. | |
| 6,822,791 | B2 * | 11/2004 | Recknagel | 359/405 |
| 7,188,978 | B2 | 3/2007 | Sharrah et al. | |
| 7,243,456 | B2 * | 7/2007 | Williams et al. | 42/125 |
| 7,272,904 | B2 | 9/2007 | Larue | |
| 7,562,484 | B2 * | 7/2009 | Kim | 42/114 |
| 7,614,175 | B2 * | 11/2009 | Davis et al. | 42/127 |
| 7,669,359 | B2 * | 3/2010 | Kim | 42/124 |
| 7,739,824 | B1 * | 6/2010 | Swan | 42/124 |
| 7,802,395 | B1 * | 9/2010 | Swan | 42/127 |
| 7,823,316 | B2 * | 11/2010 | Storch et al. | 42/90 |
| 2010/0269396 | A1 * | 10/2010 | Williams et al. | 42/124 |

* cited by examiner

*Primary Examiner* — Michael Carone
*Assistant Examiner* — Michael D David

(57) ABSTRACT

An electro-optical device includes a mount assembly that reduces shock imparted to internal electro-optical components.

18 Claims, 8 Drawing Sheets

SCOPE MOUNT

CROSS-REFERENCE TO RELATED APPLICATIONS

The present application claims the benefit of U.S. provisional patent application Ser. No. 61/027,047 filed Feb. 8, 2008, the entire disclosure of which is incorporated herein by reference.

BACKGROUND OF INVENTION

Soldiers are required to acquire, identify, and accurately fire on enemy targets at distances in excess of 100 meters and may use weapon-mounted sights. These sights may be mounted on small arms such as the M4A1 carbine and other weapons and are used to provide better target observation during day and night time missions. These sights may incorporate night vision or infrared technology or may be aligned with a device incorporating night vision or infrared technology.

Night vision devices are typically equipped with one or more image intensifier tubes to allow an operator to see visible wavelengths of radiation (approximately 400 nm to approximately 900 nm). They work by collecting the tiny amounts of light, including the lower portion of the infrared light spectrum, that are present but may be imperceptible to our eyes, and amplifying it to the point that an operator can easily observe the image.

Devices with infrared sensors allow an operator to see people and objects because they emit thermal energy. Some of these devices operate by capturing the upper portion of the infrared light spectrum, which is emitted as heat by objects instead of simply reflected as light. Hotter objects, such as warm bodies, emit more of this wavelength than cooler objects like trees or buildings. Since the primary source of infrared radiation is heat or thermal radiation, any object that has a temperature radiates in the infrared.

Fusion systems have been developed that combine image intensifiers with infrared sensors. The image intensification information and the infrared information may be fused together to provide a fused image that provides benefits over just image intensification or just thermal sensing.

A weapon-mounted housing may be used to hold the image intensifier tube or infrared sensor to a host weapon. The housing may provide protection from unintended contact or debris and may be coupled to a weapon with a suitable attachment mechanism, for example a rail grabber or other clamp.

BRIEF DESCRIPTION OF THE DRAWINGS

For a better understanding of the present invention, together with other objects, features and advantages, reference should be made to the following detailed description which should be read in conjunction with the following figures wherein like numerals represent like parts.

DETAILED DESCRIPTION

Figure 1:
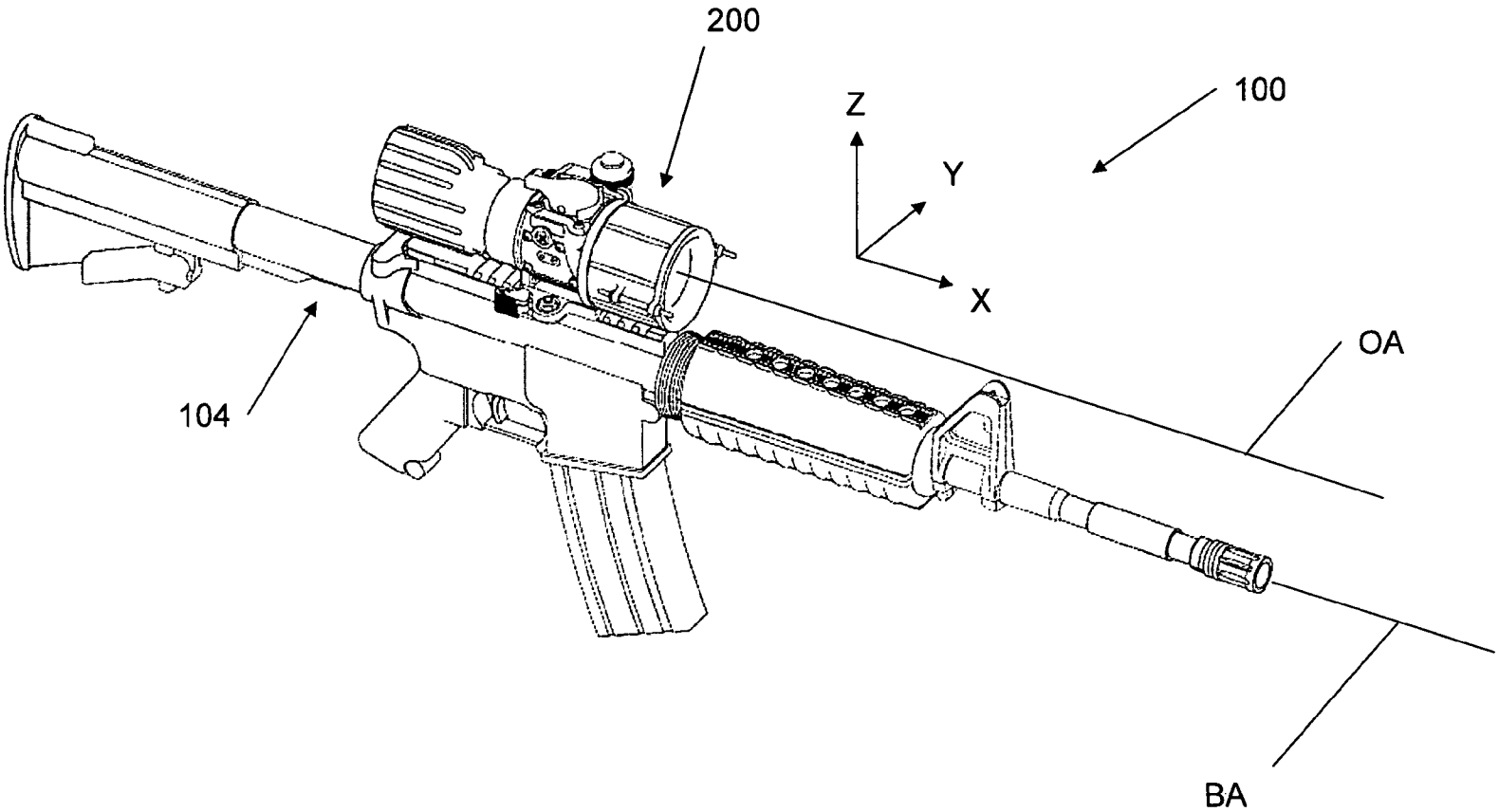
FIG. 1 is an isometric view of a weapon system consistent with an exemplary embodiment.
Figure 2:
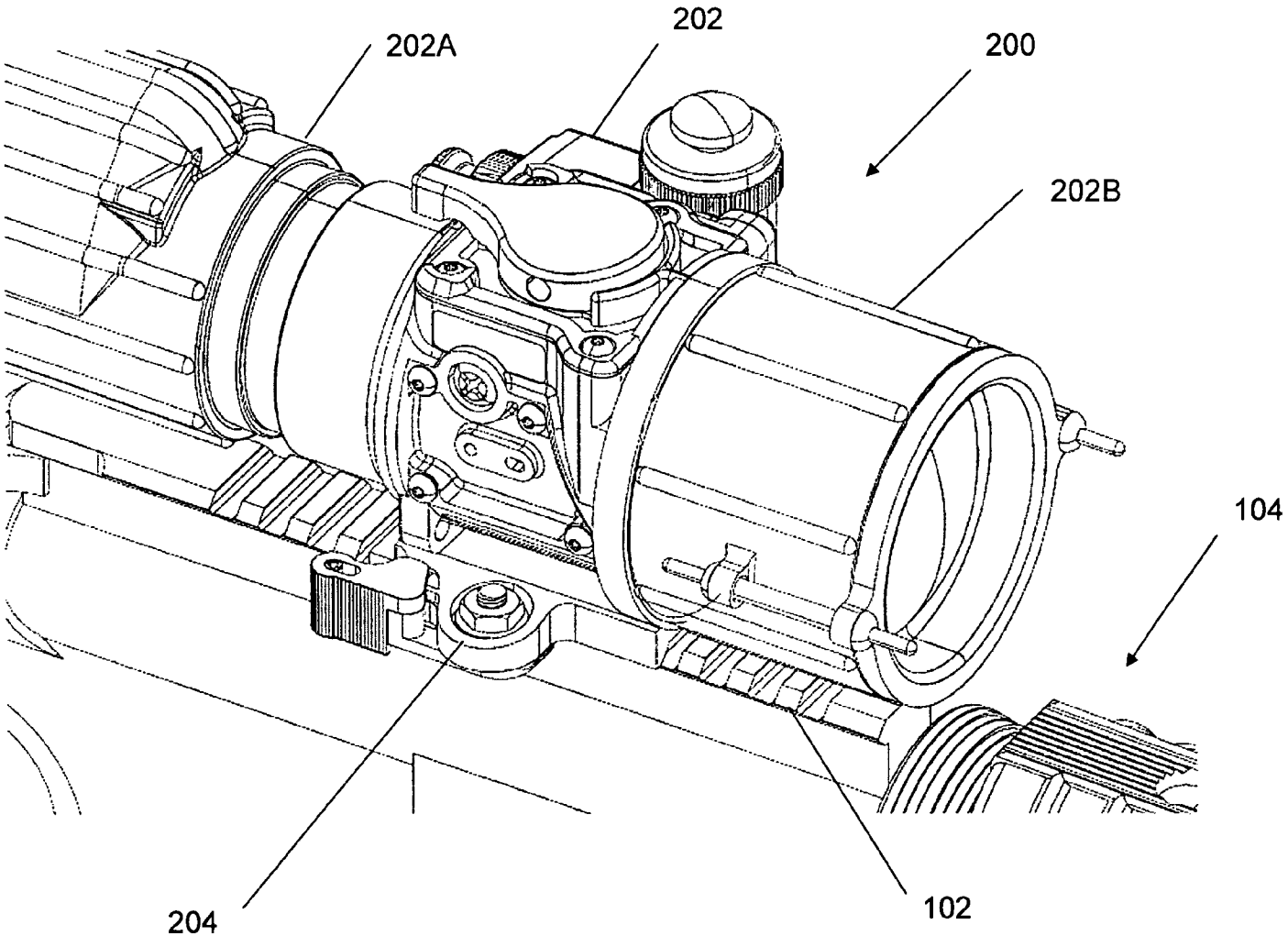
FIG. 2 is an enlarged isometric view of a portion of the weapon system of FIG. 1.

FIG. 1 is an isometric view of a weapon system 100 and FIG. 2 is an enlarged isometric view of a portion of the weapon system 100 consistent with an exemplary embodiment. The weapon system 100 may include a weapon 104 having a generally longitudinally extending mounting rail 102 and an electro-optical sighting device 200. The sighting device 200 may have an optical axis OA and the weapon 104 may have a barrel axis BA. The sighting device 200 may have a housing 202, 202A, 202B for providing protection to internal components from unintended contact or debris. The sighting device 200 may be removably coupleable to the weapon 104 such as the M4A1 carbine with a suitable mounting assembly 204. For use after the sighting device 200 is coupled to the weapon 104, the housing 202 may have one or more adjustors to allow an operator to boresight the sighting device 200 with a projectile point of impact on a target at a known distance or with a boresight alignment tool, for example a barrel mounted boresight laser. The adjustors may be orthogonally offset 90 degrees from each other to provide elevation and windage adjustment. Springs or other biasing mechanisms may be used to provide a counter force to the adjustors. Alternatively, electrically controllable actuators, for example MEMS or piezoelectric actuators, may be used to provide elevation and windage adjustment.

Host weapons are subject to shock from being dropped and when fired can generate shock pulses in excess of 800 Gs. Sighting device have electronics, including image intensifier tubes, focal plane arrays, displays, and optics that may be damaged or become misaligned if excessive shock is imparted thereto.

Figure 3:
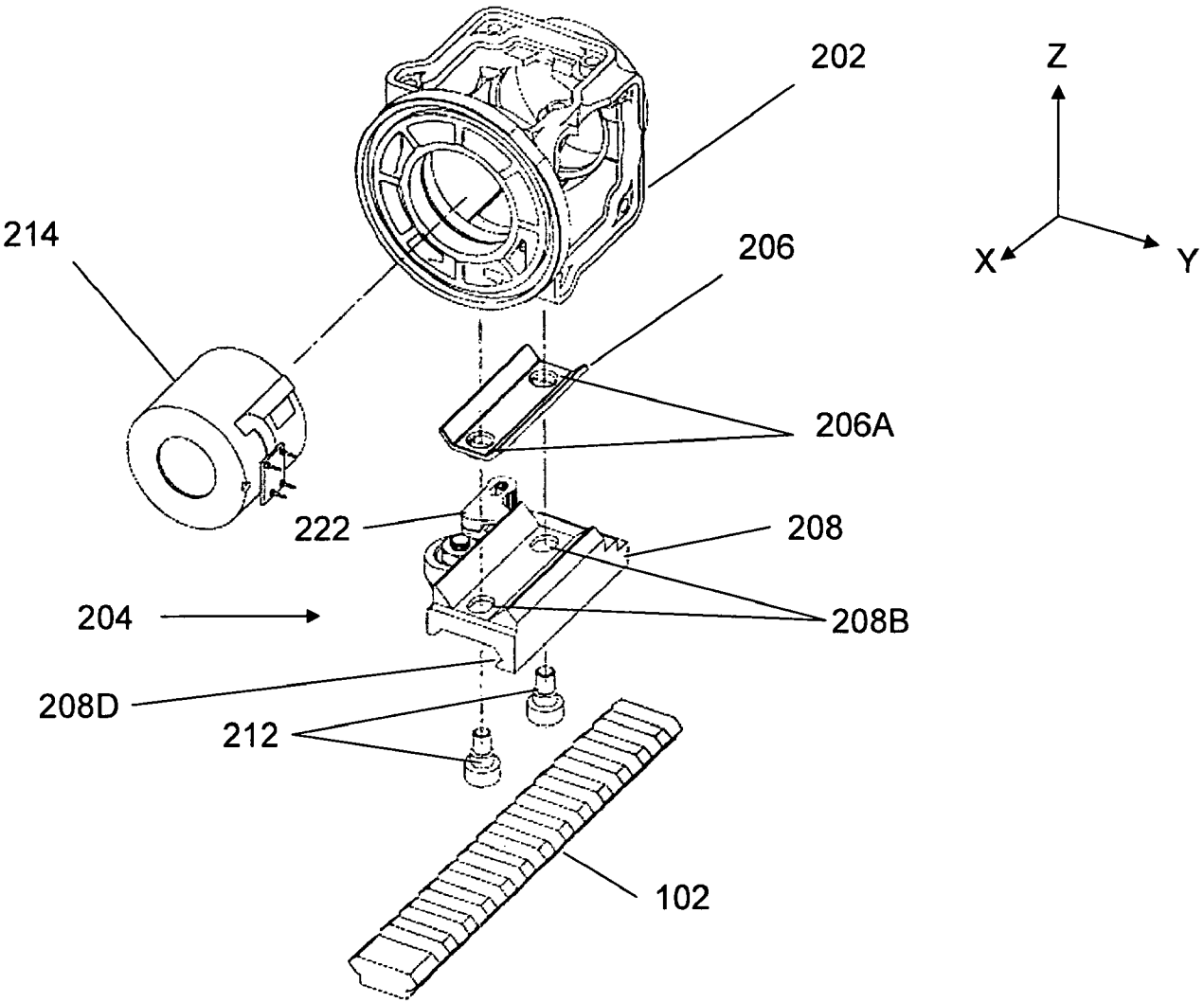
FIG. 3 is an exploded isometric view of an electro-optical sighting device and mount assembly consistent with an exemplary embodiment.
Figure 4A:
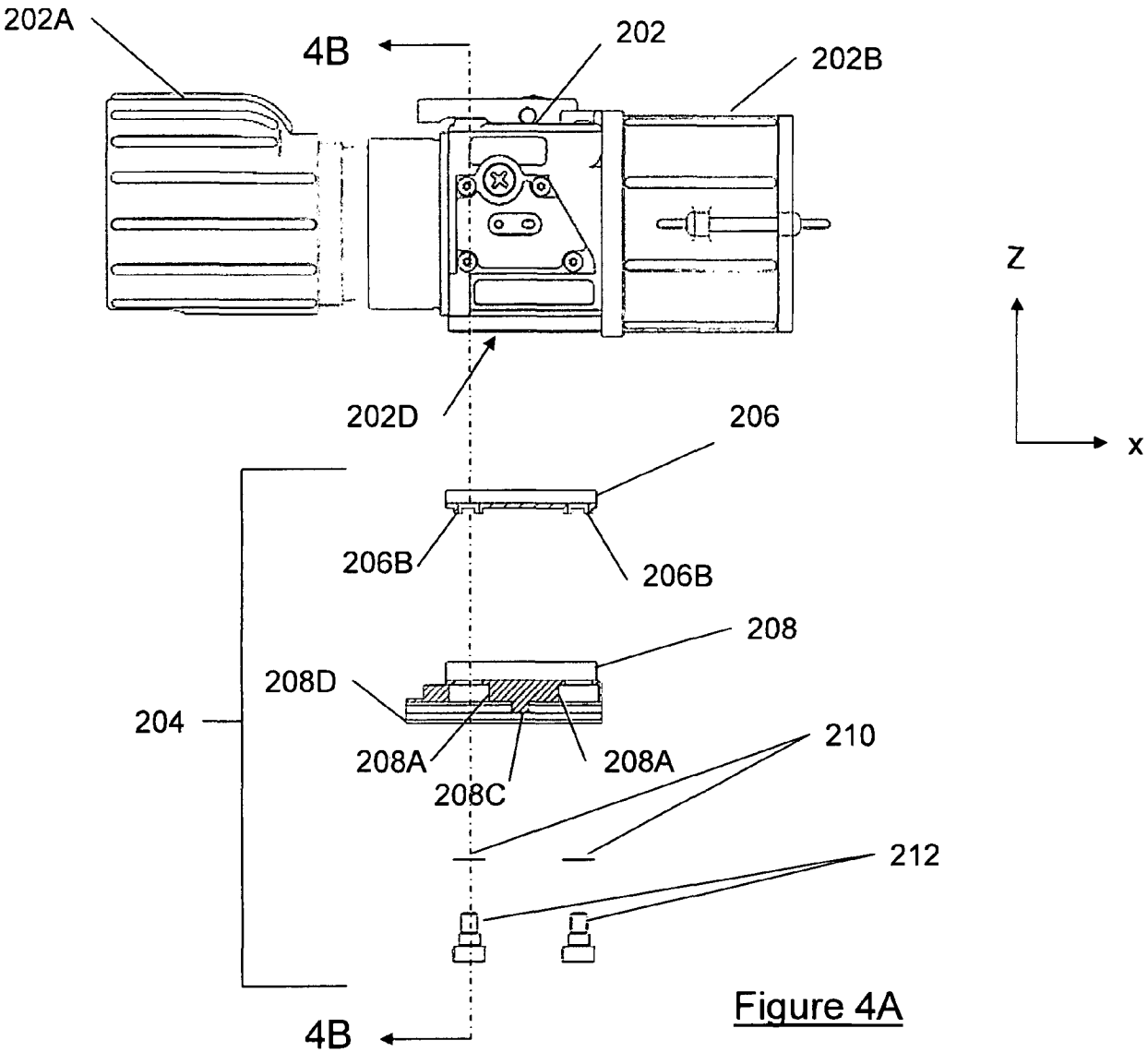
FIG. 4A is an exploded profile view of the electro-optical sighting device and mount assembly of FIG. 3.
Figure 4B:
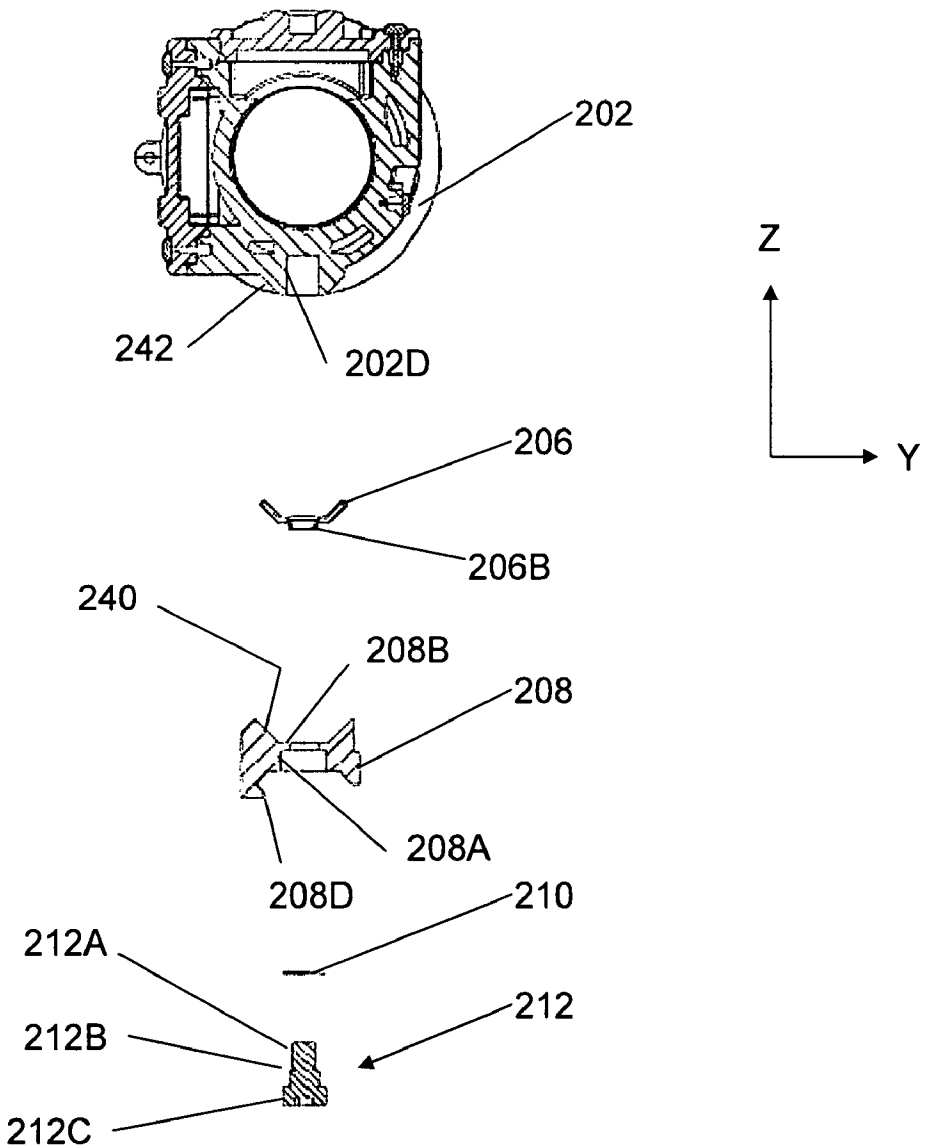
FIG. 4B is an exploded end section view of the electro-optical sighting device and mount assembly of FIG. 3 taken through line 4B-4B.
Figure 5A:
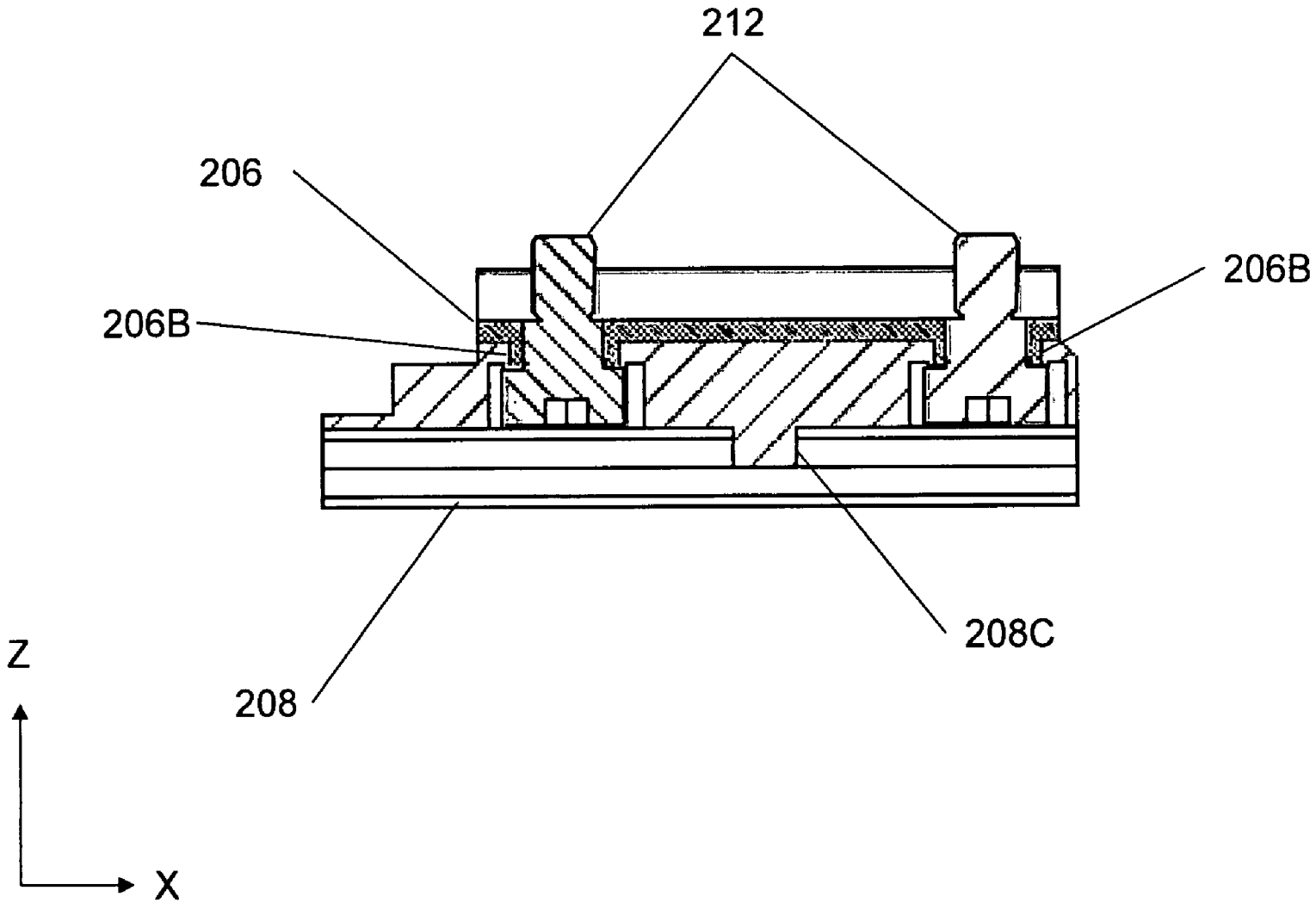
FIG. 5A is first cross sectional view of the mount assembly of FIG. 3.
Figure 5B:
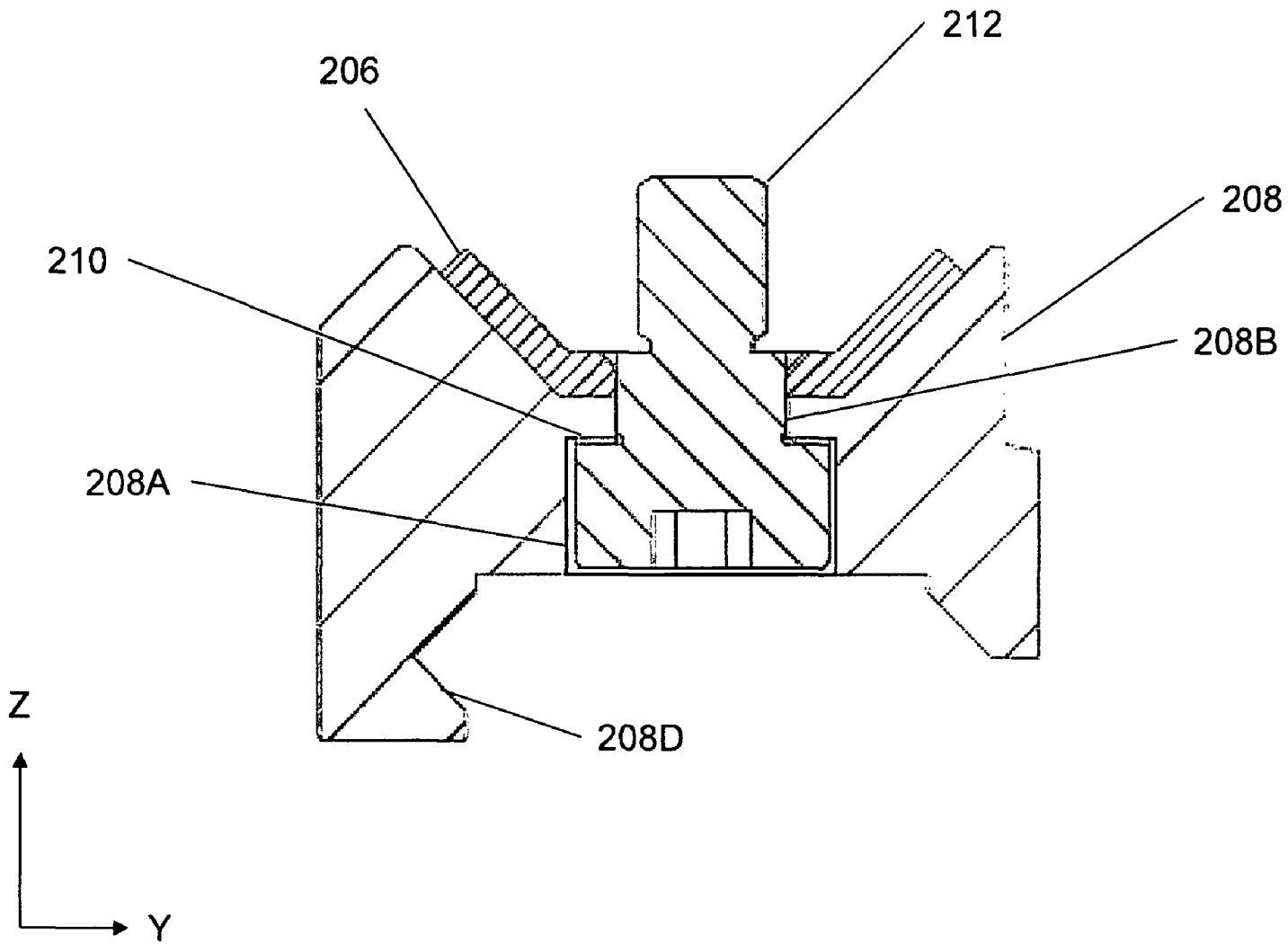
FIG. 5B is a second cross sectional view of the mount assembly of FIG. 3.

FIG. 3 is an exploded isometric view, FIG. 4A is an exploded profile view, and FIG. 4B is an exploded end section view of the electro-optical sighting device 200 and mount assembly 204 and FIG. 5A is a cross sectional profile view and FIG. 5B is a cross sectional end view of the mount assembly 204 consistent with an exemplary embodiment. An electro optical component 214, for example an image intensifier tube, a focal plane array, or a display, may be mounted at least partially within the housing 202 along with other support electronics. A pad 206 with through holes 206A may be disposed between a base 208 and the housing 202. One or more fasteners 212, for example screws, may extend through a washer 210, the base 208, the pad 206 and into one or more openings 202D, for example threaded openings, in the housing 202. The pad 206 may be made of an elastomer, for example silicone rubber having a 30-70 Shore A durometer reading and be 0.040-0.075" thick. The pad 206 may be adhered to the base 208. The fasteners 212 may be torqued to set a preload in the pad between 10 and 30%. The fasteners 212 or openings 202D may have a threadlocker applied thereto to prevent the fasteners from backing out. The fasteners 212 may have a threaded portion 212A, a shoulder portion 212B, and a head portion 212C.

The base 208 may have a fixed portion 208D shaped to cooperate with the profile of the rail 102 along a first side of the rail and a clamping portion 220 (see FIG. 6) that can be selectively moved into engagement with an opposing side of the rail 102. A user may rotate a handle 222 coupled to the clamping portion 220 to lock/unlock the mount assembly 204 to/from the rail 102. The base 208 may have a cross piece 208C that fits in cross slots in the rails 102 to resist longitudinal travel (along the X axis). A mounting assembly may have multiple clamping portions without departing from the invention. Other mounting assemblies including "rail grabbers" with a jaw or jaws that move generally perpendicular to the longitudinal axis of the rail 102 may be used without departing from the invention. U.S. Pat. No. 4,310,980; U.S. Pat. No. 4,383,371; U.S. Pat. No. 4,446,644; U.S. Pat. No. 4,845,871; U.S. Pat. No. 5,555,662; U.S. Pat. No. 7,188,978, and U.S. Pat. No. 7,272,904 disclose mounting methods and are herein incorporated by reference in their entirety.

The base 208 may have one or more through holes 208B and a counterbore 208A. The through holes 208B may have a first dimension D1 in the Y axis and a second and larger dimension D2 in the X axis. The through holes 208B may be elongated in the X axis to allow the shoulder portion 212B of the fastener 212 to extend therethrough to allow movement in the X axis, but limit travel in the Y axis. The through holes 208B may be further elongated in the X axis to allow downwardly projecting bumpers 206B from the pad 206 to extend therein. The tolerancing between the shoulder portion 212B of the fastener 212 and the width of the through hole 208B (in the Y axis) being tighter than the tolerancing between the shoulder portion and the length of the through hole (in the X axis). For example, the tolerancing between the shoulder and the width of the slot may be designed to be a reliable running fit (e.g. RC4-RC7) or loose running fit (e.g. RC8-RC9) with the tolerance in the X axis in excess of 0.025" being acceptable. The length of the shoulder portion 212B may be controlled to provide adequate compression of the pad 206. A top surface 240 of the base 208 may be contoured to mate with a bottom surface 242 of the housing 202.

The fasteners 212 may be aligned along the X axis. Due to the sizing of the fasteners 212, the openings 208B and the downwardly projecting bumpers 206B, the sighting device 200 may move along the X axis when the weapon 104 is fired and then return to its neutral position. The sizing of the fasteners 212 and the openings 208B limiting travel in the Y axis and therefore maintaining alignment of the optical axis OA of the sighting device 200 parallel with the barrel axis BA of the weapon 104.

Figure 6:
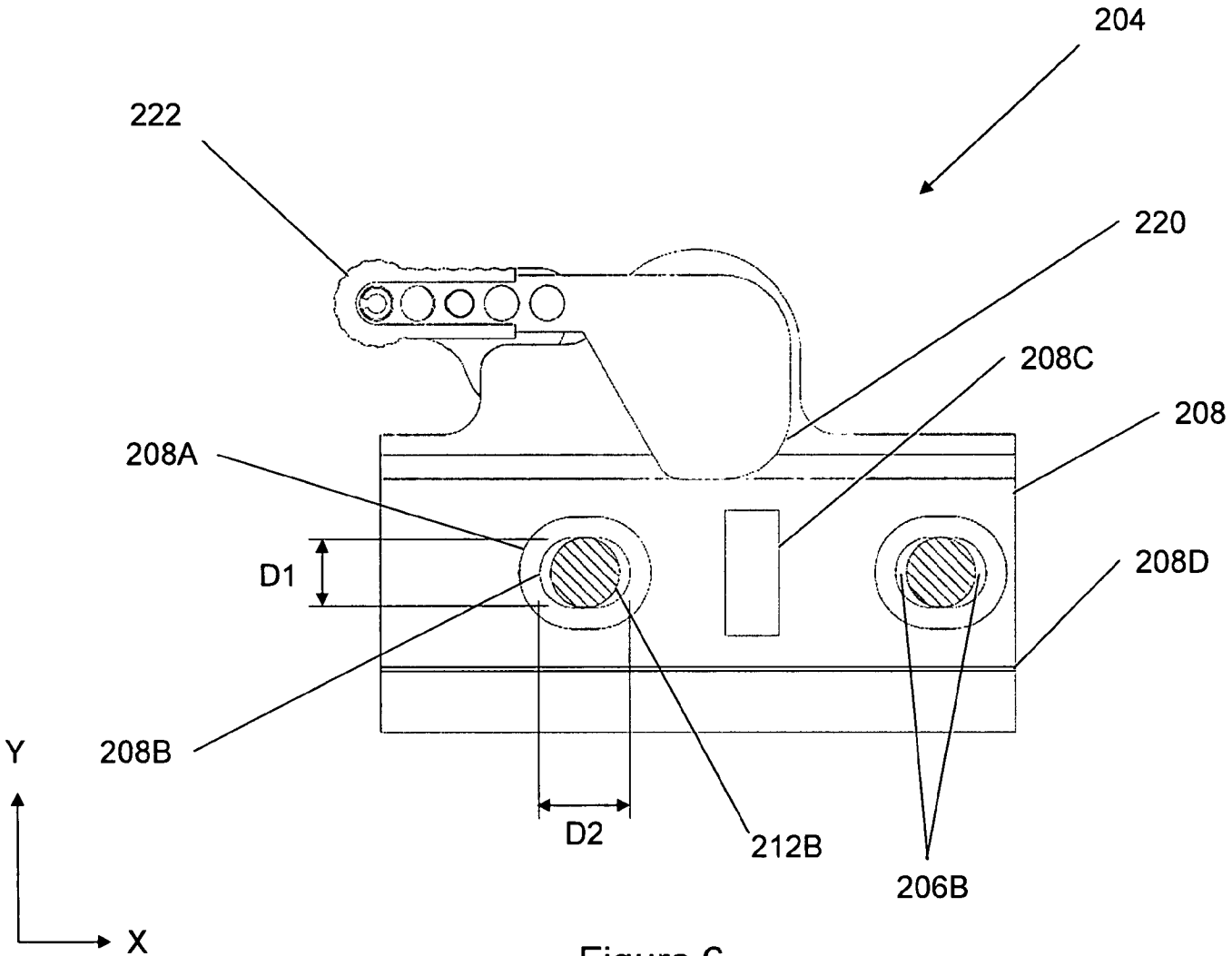
FIG. 6 is bottom view of the mount assembly of FIG. 3.

FIG. 6 is a bottom view of the mount assembly 204. The downwardly projecting bumpers 206B from the pad 206 provide cushioning along the X axis.

It will be understood that the foregoing is only illustrative of the principles of the invention and that various modifications can be made by those skilled in the art without departing from the scope and spirit of the invention. Various aspects disclosed in the exemplary embodiments may be incorporated with aspects disclosed in other exemplary embodiments without departing from the scope of the invention. Persons skilled in the art will also appreciate that the present invention can be practiced by other than the previously described exemplary method, which are presented for purposes of illustration rather than of limitation and that the present invention is limited only by the claims that follow.

What is claimed is:

1. An electro-optical assembly, comprising:

a housing for at least partially enclosing an electro-optical component; and a mount assembly having a base and a moveable member cooperating to allow for attachment and release of the base to a rail of a weapon, the base having a top surface that cooperates with a mating surface on the housing, the base having one or more openings extending through and generally perpendicular to the top surface, the openings having a first dimension in a first axis and a second and larger dimension in a second axis that is perpendicular to the first axis, a pad in contact with the top surface of the base and the mating surface of the housing, and one or more fasteners extending through the base and pad and into the housing, tolerance between a shoulder portion of the fastener and the one or more openings being tighter in the first axis than in the second axis.

2. The electro-optical assembly of claim 1, wherein the electro-optical component is an image intensifier tube.

3. The electro-optical assembly of claim 1, wherein the second axis is parallel with an optical axis of the electro-optical component.

4. The electro-optical assembly of claim 1, wherein the second axis is parallel with a longitudinal axis of the rail.

5. The electro-optical assembly of claim 1, wherein the pad has downwardly extending bumpers that fit inside the one or more openings on opposing sides of the one or more fasteners along an axis parallel with the rail.

6. The electro-optical assembly of claim 1, wherein the pad is an elastomer having a Shore A durometer reading between 35 and 70.

7. A weapon system, comprising:

a weapon having a rail extending parallel to a barrel;

a housing for at least partially enclosing an electro-optical component; and a mount assembly having a base and a moveable member cooperating to allow for attachment and release of the base to the rail of the weapon, the base having a top surface that cooperates with a mating surface on the housing, the base having one or more openings extending through and generally perpendicular to the top surface, the openings having a first dimension in a first axis and a second and larger dimension in a second axis that is perpendicular to the first axis, a pad in contact with the top surface of the base and the mating surface of the housing, and one or more fasteners extending through the base and pad and into the housing, the tolerance between a shoulder portion of the fastener and the one or more openings being tighter in the first axis than in the second axis.

8. The weapon system of claim 7, wherein the electro-optical component is an image intensifier tube.

9. The weapon system of claim 7, wherein the second axis is parallel with an optical axis of the electro-optical component.

10. The weapon system of claim 7, wherein the second axis is parallel with a longitudinal axis of the rail.

11. The weapon system of claim 7, wherein the pad has downwardly extending bumpers that fit inside the one or more openings on opposing sides of the one or more fasteners along an axis parallel with the rail.

12. The weapon system of claim 7, wherein the pad is an elastomer having a Shore A durometer reading between 35 and 70.

13. A mount for coupling an electro-optical device to a rail of a weapon, comprising:

a base and a moveable member cooperating to allow for attachment and release of the base to the rail of the weapon, the base having a top surface that cooperates with a mating surface on a housing of the electro-optical device, the base having one or more openings extending through and generally perpendicular to the top surface, the openings having a first dimension in a first axis and a second and larger dimension in a second axis that is perpendicular to the first axis;

a pad in contact with the top surface of the base and the mating surface of the housing; and one or more fasteners extending through the base and pad and into the housing, the tolerance between a shoulder portion of the fastener and the one or more openings being tighter in the first axis than in the second axis.

14. The mount of claim 13, wherein the electro-optical device comprises an image intensifier tube.

15. The mount of claim 13, wherein the second axis is parallel with an optical axis of the electro-optical device.

16. The mount of claim 13, wherein the second axis is parallel with a longitudinal axis of the rail.

17. The mount of claim 13, wherein the pad has downwardly extending bumpers that fit inside the one or more openings on opposing sides of the one or more fasteners along an axis parallel with the rail.

18. The mount of claim 13, wherein the pad is an elastomer having a Shore A durometer reading between 35 and 70.

* * * * *